US005230425A

United States Patent [19]

Edqvist et al.

[11] Patent Number: 5,230,425

[45] Date of Patent: Jul. 27, 1993

[54] CARRIER FOR BUNCH PACKAGING OF CANS

[76] Inventors: Håkan Edqvist, Mosstorpsvägen 40, Skärblacka, Sweden, S-617 00; Jan Lind, Rågången 71, Norrköping, Sweden, S-602 12

[21] Appl. No.: 844,635

[22] PCT Filed: Oct. 17, 1990

[86] PCT No.: PCT/SE90/00669

§ 371 Date: Apr. 2, 1992

§ 102(e) Date: Apr. 2, 1992

[87] PCT Pub. No.: WO91/05716

PCT Pub. Date: May 2, 1991

[30] Foreign Application Priority Data

Oct. 19, 1989 [SE] Sweden ..... 8903443

[51] Int. Cl.[5] ..... B65D 71/00

[52] U.S. Cl. ..... 206/153; 206/147; 206/160

[58] Field of Search ..... 206/139, 141, 145, 147, 206/149-161; 294/87.2

[56] References Cited

U.S. PATENT DOCUMENTS

| | | | |
|---|---|---|---|
| 3,128,034 | 4/1964 | Weiss | 206/154 |
| 3,194,476 | 7/1965 | Weiss | 206/154 |
| 3,245,711 | 4/1966 | Danton | 206/153 |
| 3,302,784 | 2/1967 | Copping | 206/153 |
| 3,432,202 | 3/1969 | Ebelhardt | 206/158 |
| 3,653,503 | 4/1972 | Arneson | 206/153 |

FOREIGN PATENT DOCUMENTS

| | | | |
|---|---|---|---|
| 2298489 | 9/1976 | France | 206/153 |
| 0433109 | 9/1967 | Switzerland | 206/153 |

*Primary Examiner*—Jimmy G. Foster

*Attorney, Agent, or Firm*—Lerner, David, Littenberg, Krumholz & Mentlik

[57] ABSTRACT

The present invention relates to a carrier for packaging two or more cylindrical cans together in at least one line, each of said cans being provided with a neck with a reduced diameter close to an attached cover, said carrier being produced from a cardboard blank having two convex slots side by side for each can, the distance between said slots being smaller than the diameter of the cover, and wherein each of the arc shaped slots is complemented by at least two radially pointing tabs, when in use, each pair of slots being arranged outwardly running short slots for making a series of inward to grip with their outer edges immediately below the cover at opposite sides of each can.

4 Claims, 3 Drawing Sheets

CARRIER FOR BUNCH PACKAGING OF CANS

TECHNICAL FIELD

The present invention relates to a carrier for packaging two or more cylindrical cans together in at least one line, each of said cans being provided with a neck with a reduced diameter close to an attached over, said carrier being produced from a cardboard blank having two convex slots side by side for each can, the distance between said slots being smaller than the diameter of the cover, and wherein each of the arc shaped slots is complemented by at least two radially outwardly running short slots for making a series of inward pointing tabs, hen in use, each pair of slots being arranged to grip with their outer edges immediately below the cover at opposite sides of each can.

PRIOR ART

Cans according to the above are used for packaging of beer, soft drinks and mineral water. These drinks are often bought in a number of cans and there is a need of bringing about means for a bunch packaging of cans so that the customer can handle the cans in such group as a unit.

Several solutions to bring abut said bunch packaging exist. For example there are combinations of cardboard and plastics where one uses a bottom f cardboard and a wrapper of a stretching or shrinking film. This solution is primarily used for large units comprising 24 cans.

Further pure plastics solutions also exist where one from a reel applies a row of connected rings, usually 2 in parallel, which are applied in such a way around the cans that they grasp around it below the part having reduced cylindrical diameter below the cover. It happens thus that these rings are disposed in the nature by inconsiderate people. It has many times happened that wild animals have got entangled in the plastic hooks and have suffered a painful death.

Besides that banderols of carton for bunch packaging of cans exist. This solution is not satisfactory as it is not suitable for use when the number of cans are uneven. Further the cost for such a cardboard banderol is such that it is not suitable to use it for carrying smaller groups than six cans. The cardboard material has, however, great advantages with regard to the environment as it is quickly decaded in the nature and does not give rise to any appreciable amounts of remnant when being burnt.

Cardboard carriers for bunch packaged cans are earlier known through GB 1604840 which have been provided with two vertically downwardly folded flaps which via a punched straight slot grasps the underside of the cover for the can, i.e. is supported against the cover edge at diametrically opposite sides of the can.

The U.S. Pat. No. 3,094,210 shows similar cardboard carriers having vertically downwardly folded flaps which grasp at the underside of the can cover. A substantial disadvantage with these known carriers is that the flaps carrying the cans extend downwardly along the sides of the cans and easily can hook on something so that the flaps can be folded upwardly and loose the grasp about the cover edge. Further the grasping principle is based on that the cardboard material is elastic so that it "squeezes" on both sides of the can. A problem by using such an elastical cardboard material is that the carton tends to absorb humidity, for example from the humid environment which is usual within breweries. The ability of the carrier to keep the cans is thereby appreciably lowered The risk is also great that the carton is split at its ends. These disadvantages have resulted in that these known carton carriers do not satisfy the demand which has to be put on a product of this kind namely that it shall be able to maintain the cans in a safe way and to be applicable on cans in a rational way in a difficult environment.

TECHNICAL PROBLEM

One object of the invention is to bring about a carrier for cans which can be made from a comparatively thin cardboard blank which carrier satisfies the above mentioned demands and gives the possibility to variation with regard to the number of cans.

THE SOLUTION

For this purpose the invention is characterized in that each of the arc shaped punched grooves are completed with at least two radially outwardly running short punched grooves for making a series of flaps and that in a part diametrically opposite to each can has such a width and shape that in parallel arranged bunch packed cans or groups of bunch packed cans can stand closely against each other without any interspace.

According to a preferred embodiment example of the invention the arc shaped punched grooves are shaped substantially elliptical.

Suitably each of these punchings are made up of a number of straight punching segments.

According to a further preferred embodiment example of the invention flaps have been arranged in that part of the flap parts of the carrier which are located between two closely against each other standing cans.

Suitably said flap parts are delimited in a direction against the punchings by means of folding lines arranged close to these and parallel to the longer sides. These folding lines are according to a further preferred embodiment of the invention provided with short punchings at the shorter sides.

The flap parts are suitably provided with arc shaped notches which reduce the width diametrically opposite to each can. The term cans as used in the specification and claims should be interpreted as also including jars, pots or tins.

According to a further embodiment of the invention the side edges of the carrier are located in the area of the part having reduced cylinder diameter.

DESCRIPTION OF THE DRAWINGS

The above mentioned and further properties of the invention will be described more in detail in the following with reference to the attached drawings on which FIG. 1 in perspective shows a carrier with two cans according to the invention.

PREFERRED EMBODIMENTS

Figure 1:
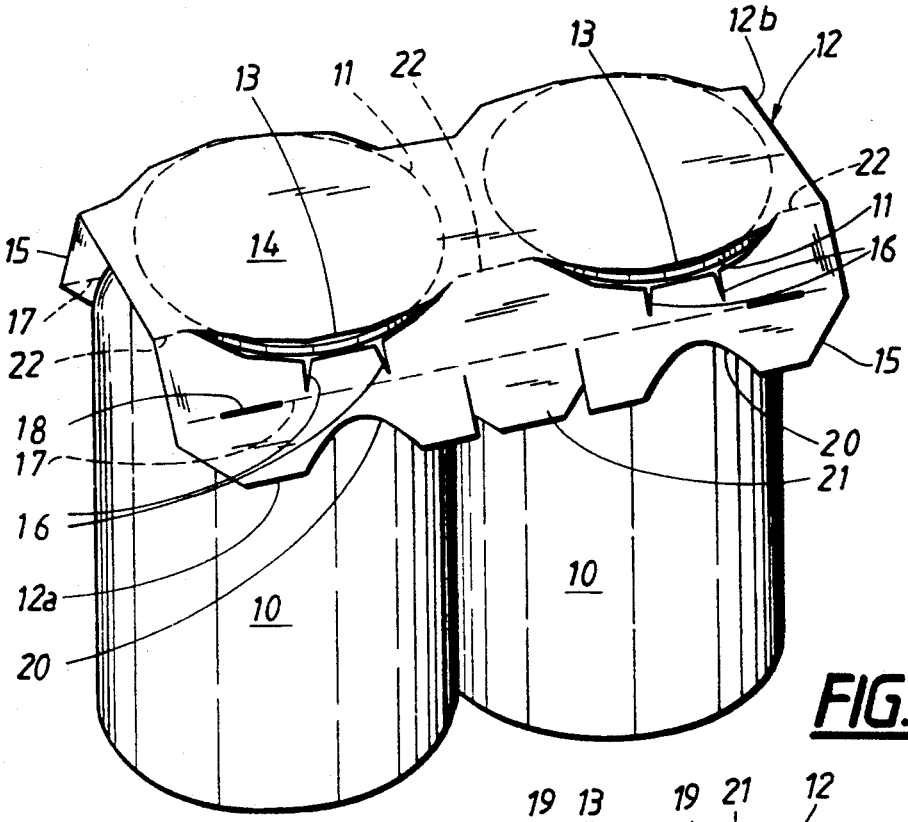

FIG. 1 shows two cylindrical soft drink cans 10 of conventional type which have been made through drawing of aluminium plates. The can has at its opening a reduced cylindrical diameter and the can has in a known way after being filled with some drink been sealed by flanging a cover 11 at the edge of the opening of the can. The two cans are held together by means of a substantially rectangular cardboard piece 12 having parallel long and short sides 12*a* and 12*b* which cardboard piece has been provided with punched openings 13, the outer edges of which grasp around diametrically opposite sides of each can cover 11. Hereby the cardboard blank 12 forms a plane surface 14 which substantially covers the cover of the cans and besides that extend obliquely outwards-downwards having flap parts 15.

The plane surface 14 can be used as a printing base, for example for information of the product and/or advertisement. By letting the plane surface substantially cover the cover of the can the risk that this part of the can where the opening arrangement is located shall be contaminated during transport o storing is reduced.

Figure 2:
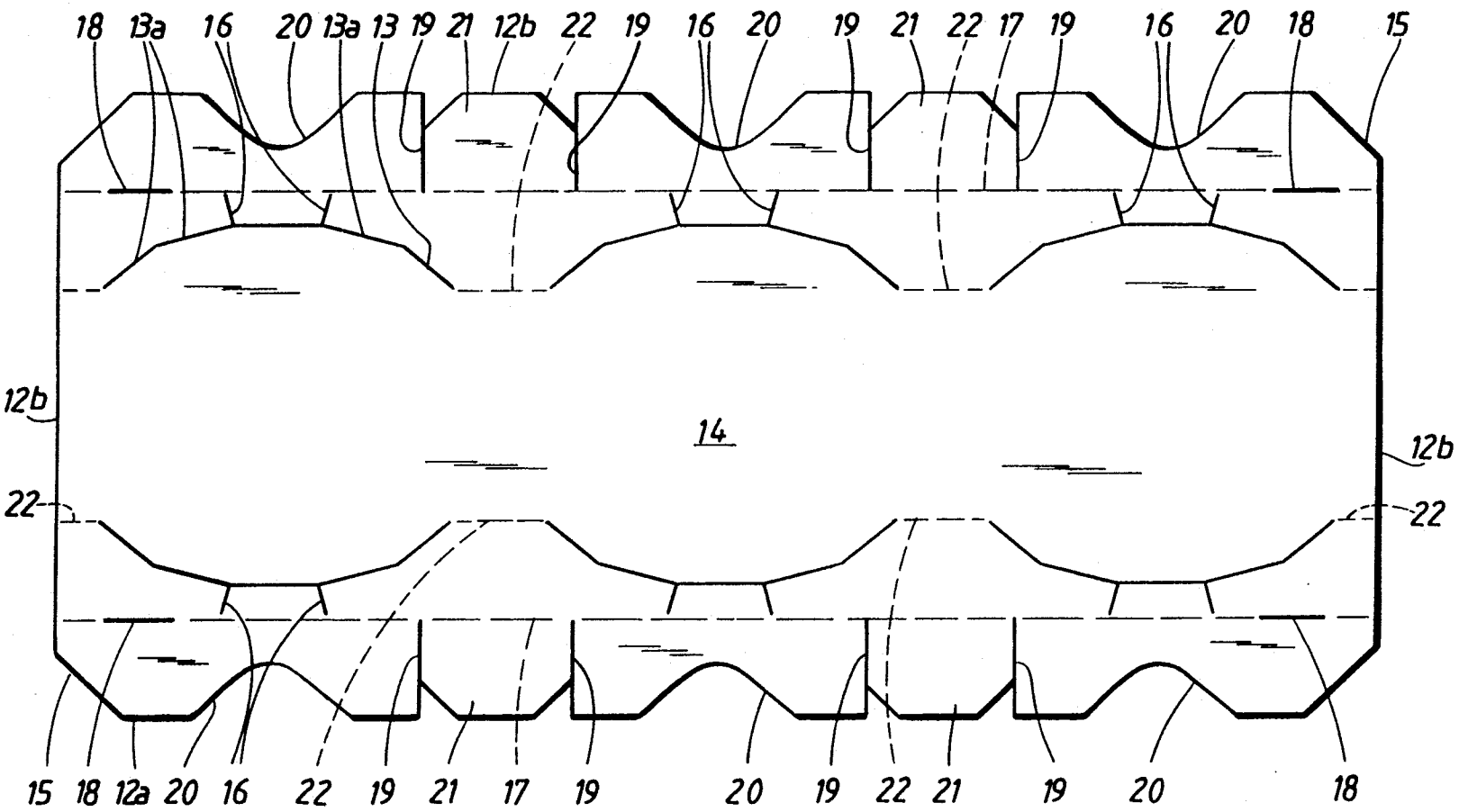
FIG. 2 shows a plane cardboard blank for the carrier for three cans according to the invention.

The cardboard blank 12 is shown more in detail in FIG. 2 from which it appears that the punching openings 13 each are shaped as a series each having straight punching segments 13*a* which are combined so that they extend in a continuous elliptical arc. The two openings 1 arranged for a can are located at a mutual distance which is smaller than the diameter of the cover. To make it possible to put down the carton piece 12 over the cover 11 the arc shaped punchings 13 are completed with two short radially upwardly running punchings 16. These punchings 16 extend to a folding line 17 which extends along each long side 12*a* and have a certain distance to this one. The folding lines 17 are provided with short punchings 18 at the shorter sides 12*b*. These punchings 18 have the object to give these parts of the carton blank 12 a greater shapability.

The flap parts 15 have been formed by arranging transverse slots 19 at the longer sides 12*a* extending to the folding line 17. The flap parts 15 have been provided with arc shaped notches 20 which are intended to make it possible for the cans to stand closely against each other without any interspace. Between the flap parts 15 are comparatively shorter flap parts 21 which partly facilitate for the fingers to grasp the bunch package and partly contribute to distribution of the pressure and the tension forces in the cardboard material so that the cans are kept better when they are lifted.

The cardboard blank 12 has also been provided with short folding lines 22 which are parallel with the folding lines 17 and connect the ends of the arc shaped punchings 13 to each other and to the shorter sides 12*b*.

As appears from FIG. 1 the applied carrier 12 has a plane upper side 14 and obliquely downwardly directed side parts. These side parts start at a certain angle at the folding lines 22 and get a somewhat steeper angle downwardly at the folding lines 17. In this way the outer edges of the arc shaped punchings 13 can grasp at the under side of the edge folding of the can cover while the inner side of the carton parts co-operating herewith abut against conically upwardly sloping surfaces on the can part having the reduced cylindrical diameter.

In practice it has shown that the grasp of the carton carrier about the can neck is so firm that it cannot be broken without relatively great effort. By the shape of the flap parts a necessary formability of the carton blank is obtained so that this can be applied in a quick and rational way without being damaged.

Figure 3:
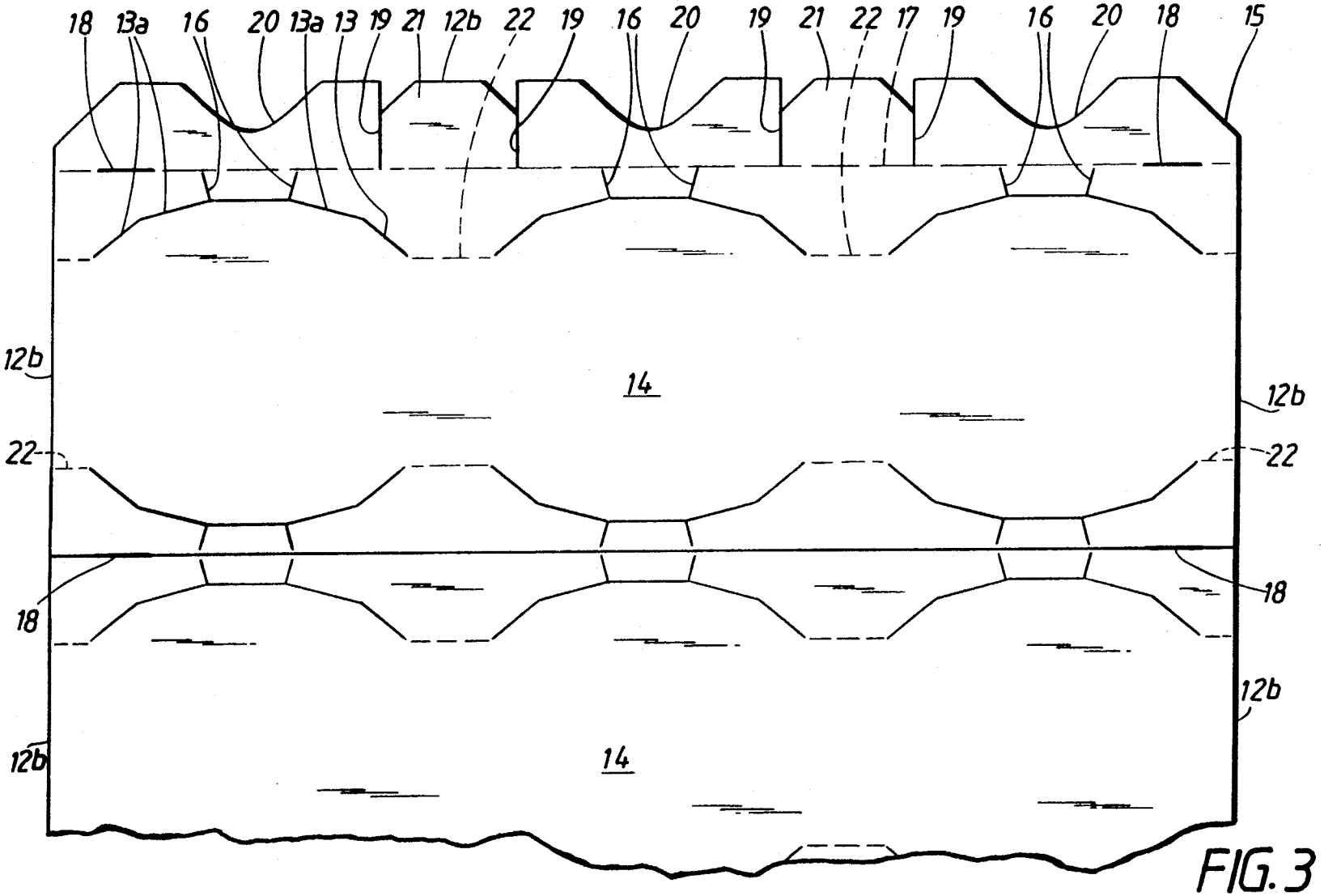
FIG. 3 shows a further embodiment example of the carrier corresponding to FIG. 2 which is intended for six cans.

FIG. 3 shows a variant of the invention where two carton blanks each intended for three cans are combined so that they form a bunch package for six cans. The two carton blanks are united along the folding line 17 by folding of the flap part 15, 21 90° downwardly and connecting by means of some suitable adhesive.

Figure 4:
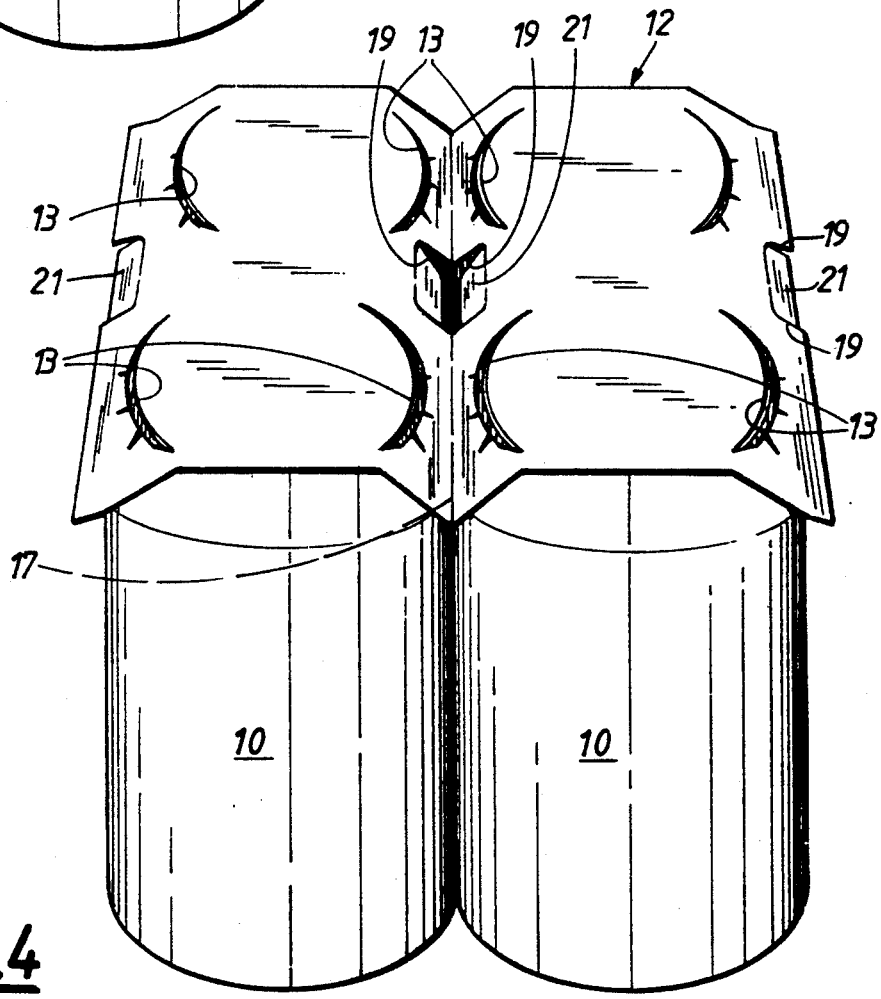
FIG. 4 shows in an end-view a variation of the invention which is applied for two parallel rows of cans.

FIG. 4 shows a variant of the invention where the carrier for two parallel rows of cans have been shaped of one carton blank which is not combined of separate parts but have been made from a single piece having a common folding line 17. In this embodiment the punching grooves 16 are shorter and are present in a greater number for example five at each punching 13 which means that the number of flaps which support the under side of each cover also increases giving a more efficient grasp around the can. Further, the side parts have been reduced so that they do not extend longer downwardly than the height of the parts having reduced cylindrical diameter of the cans. The carrier is provided with punchings 19 between the cans which makes it possible to shape a finger grip between the cans by moving the forefinger down between the rows of the cans and use the thumb and middle finger on each side of the carrier in a "three finger grip". By lifting in the finger grip such pressure and tension forces are obtained on the flaps as are limited by the lines 16, 13 and 16 that the grip of the cans is improved.

The above described carrier is suitable for automatic application at the production of drinks. For example trays for co-distribution of 24 cans in one unit are used. A number of carriers can then be shaped in one continuous blank for 24 cans which blank is shaped before the application so that a longitudinal folding between neighbouring lifting surfaces are formed from folding lines and the partition line between the rows. The partition line is made from neighbouring carton surfaces which only are kept together via short bridges of carton (indication of fracture). This partition line is the lower point of the folding. By this shape the lifting edge will be formed at the same time under the cover of the cans at the application. The carton bridges are then cut off in the folding line. Corresponding bridges on the shorter sides of the cans are also cut so that a desired pattern for carriers for 2, 3 or some other number of cans is formed.

The mounting of the carrier can also occur on an assembly band where one, two or more rows of cans are provided with a continuous band of carton when being moved.

The above described carriers have on the figures been shown in varieties for two, three or six cans. Other variations are for example four, five or still more cans can easily be obtained by using the above described basic elements in the cardboard blank.

The invention is not limited to the above described embodiment example and more variations are thinkable within the scope of the following claims. By variation of the length of the arc shaped punchings or the rigidity of the cardboard material the carrier according to the invention can be optimised for cans of different size and weight, for example 33, 45 and 50 cl.

We claim:

1. A carrier for retaining a plurality of cans arranged in at least one line, each of said cans having a circular cover thereon, each of said covers defining a predetermined diameter and having a bottom edge thereon, said carrier comprising: a cardboard blank having a plurality of arc-shaped slots therein, each of said arc-shaped slots having a concave side and a convex side and a center point, each of said circular covers being associated with a pair of said arc-shaped slots, said pair of said arc-shaped slots being arranged with said concave sides facing each other wherein the distance between said center points of said pair of said arc-shaped slots is smaller than said diameter of said cover when said carrier is in use and thus applied on said cans, said cardboard blank further having a plurality of radially outwardly extending short slots extending from said convex side of said arc-shaped slots, each pair of said plurality of radially outwardly extending short slots defining an inwardly pointing tab having an outer edge thereon, said carrier being arranged in a normally assembled position on said plurality of cans so that said inwardly pointing tabs extend obliquely towards said bottom edge of said cover and said outer edge thereof engages one of said cans immediately below said cover, said cardboard blank further including cut-in-portions arranged on opposite sides of each line of said cans, said cut-in-portions being adapted to be gripped when lifting said carrier.

2. The carrier of claim 1 wherein said cardboard blank is rectangular and includes parallel long sides and short sides.

3. The carrier of claim 2 wherein said cardboard blank includes arc-shaped notches arranged in said long sides at opposite sides of each can.

4. The carrier of claim 1 wherein each of said plurality of cans include a body and a neck, said diameter of said neck being smaller than said diameter of said body, each of said plurality of arc-shaped slots having an inner edge and an outer edge, each pair of said outer edges of said plurality of arc-shaped slots being arranged around a respective one of said necks of said plurality cans when said carrier is in assembled position thereon.

* * * * *

UNITED STATES PATENT AND TRADEMARK OFFICE

CERTIFICATE OF CORRECTION

PATENT NO. : 5,230,425

DATED : July 27, 1993

INVENTOR(S) : Edqvist et al.

It is certified that error appears in the above-indentified patent and that said Letters Patent is hereby corrected as shown below:

Column 1, line 8, "over" should read --cover--.
Column 1, line 15, "hen" should read --when--.
Column 1, line 28, "f" should read --of--.
Column 3, line 18, "o" should read --or--.
Column 3, line 24, "1" should read --13--.

Signed and Sealed this

Nineteenth Day of April, 1994

Bruce Lehman

*Attest:*

BRUCE LEHMAN

*Attesting Officer*

*Commissioner of Patents and Trademarks*